US010351215B2

(12) United States Patent
Scozzoli

(10) Patent No.: US 10,351,215 B2
(45) Date of Patent: Jul. 16, 2019

(54) VESSEL WITH MOVING STERN SWIM PLATFORM SUPPORTING STEPS SLIDING OVER FIXED STERN STEPS

(71) Applicant: FERRETTI S.P.A., Cattolica (RN) (IT)

(72) Inventor: Saverio Scozzoli, Forlì (IT)

(73) Assignee: FERRETTI S.P.A., Cattolica (Rimini) (IT)

( * ) Notice: Subject to any disclaimer, the term of this patent is extended or adjusted under 35 U.S.C. 154(b) by 0 days.

(21) Appl. No.: 16/135,408

(22) Filed: Sep. 19, 2018

(65) Prior Publication Data

US 2019/0084655 A1 Mar. 21, 2019

(30) Foreign Application Priority Data

Sep. 20, 2017 (IT) ..... 102017000105321

(51) Int. Cl.

| | |
|---|---|
| ***B63B 27/16*** | (2006.01) |
| ***B63B 27/14*** | (2006.01) |
| ***B63B 27/30*** | (2006.01) |
| *B63B 19/08* | (2006.01) |

(52) U.S. Cl.

CPC ..... *B63B 27/143* (2013.01); *B63B 27/16* (2013.01); *B63B 27/30* (2013.01); *B63B 2019/086* (2013.01); *B63B 2027/141* (2013.01)

(58) Field of Classification Search

CPC ..... B63B 27/143; B63B 27/16; B63B 27/30
See application file for complete search history.

(56) References Cited

U.S. PATENT DOCUMENTS

| | | | | |
|---|---|---|---|---|
| 4,738,642 | A | 4/1988 | Koyama et al. | |
| 7,162,969 | B2 * | 1/2007 | Houlder | B63B 27/14 114/362 |
| 2011/0017122 | A1 * | 1/2011 | Muller | B63B 27/146 114/362 |
| 2013/0047910 | A1 | 2/2013 | Mueller | |
| 2016/0083050 | A1 | 3/2016 | Frabetti | |

FOREIGN PATENT DOCUMENTS

| | | | |
|---|---|---|---|
| DE | 202009007140 | U1 | 9/2009 |
| EP | 2065301 | A2 | 6/2009 |
| EP | 2275339 | A1 | 1/2011 |
| WO | 2011137548 | A2 | 11/2011 |
| WO | 2016207693 | A1 | 12/2016 |
| WO | 2017187369 | A1 | 11/2017 |

OTHER PUBLICATIONS

Search Report and Written Opinion dated May 8, 2018 for Italian patent application No. 102017000105321.

* cited by examiner

*Primary Examiner* — Stephen P Avila

(74) *Attorney, Agent, or Firm* — Vorys, Sater, Seymour and Pease LLP

(57) ABSTRACT

A vessel or boat includes a hull having a stern at which there is a stern swim platform having at least one moving part capable of moving along and close to a portion of the stern, the moving part being capable of adopting at least a first working position in which it is out of the water on which the boat floats and a second working position in which the moving part is lowered with respect to the hull into the water, steps being provided at the stern. At least part of the steps is of one piece with the moving part of the stern swim platform and moves therewith over fixed steps provided within the stern, the movement of the steps taking place in a guided way, the moving steps forming an elongatable swim ladder with the fixed steps.

19 Claims, 12 Drawing Sheets

VESSEL WITH MOVING STERN SWIM PLATFORM SUPPORTING STEPS SLIDING OVER FIXED STERN STEPS

This claims the benefit of Italian patent application no. 102017000105321, filed Sep. 20, 2017, hereby incorporated by reference in its entirety.

The present invention relates to a vessel or boat according to the precharacterising clause of the principal claim.

Boats such as yachts or the like having a hull with a space at the stern used for example to contain a small boat or tender have been known for a long time. Such space is usually closed off by its own stern door.

It is also known that many high-class boats have a stern or after swim platform at the stern defined by a surface projecting at right angles from the hull and acting as a "passerelle" for the vessel's passengers. This swim platform or passerelle may be fixed or may move with respect to the hull: in the latter case the swim platform can for example move along guides of one piece with the hull and adopt any position between a first position projecting from the hull and attached thereto and a second position in which the swim platform is wholly immersed in the water on which the vessel lies.

In the case where the vessel has a stern space, and where the swim platform is fixed to the hull, the presence of this swim platform may impede access to the stern space directly from the sea; in fact although it allows it to be present it does not permit a floodable stern space to be constructed.

For this reason, in the case of a hull with a stern space it is preferable to construct such swim platforms in a movable way so that they can free access to that space from the sea.

Usually moving stern swim platforms are attached to the hull of the vessel through the aforesaid guides (for example of the telescopic or fixed and straight type) or through articulated supports which lower the corresponding swim platform into the water when the stern space is opened, with the result that it is not easy to get from it to the vessel's hull in order to climb back aboard.

Where provision is made for the use of a tender, for example, immersion of the swim platform into the water on the one hand provides access to the tender space and for passengers to leave on such tender, but on the other hand it may make reboarding the vessel (from which the tender has been placed in the water) inconvenient for the passengers.

It is therefore known to associate moving swim platforms (or even fixed swim platforms) with swim ladders to aid the transfer of people from the swim platform immersed in the water to the vessel's hull.

For example, DE 20 2009 007140 U1 describes a vessel or boat having a moving platform at its stern which can be held out of the water on which the boat lies or is carried beneath the surface of the water by moving members hinged to the hull of the boat and rotating about such hinges. The platform may serve as a swim platform or a support for a boat.

The German prior document describes that a swim ladder which is invisible (or "disappears") when the platform is in a first working position alongside the hull and out of the water is of one piece with the platform: this swim ladder is instead revealed when the platform is immersed in the water and when such platform is completely immersed (that is in a second working position) the swim ladder is completely visible and is used to easily reach the boat's hull and leave therefrom from the platform immersed in the water.

In one embodiment the swim ladder is hinged to the platform at one end, while the other end is hinged to the hull.

In another embodiment the swim ladder is freely supported on the moving platform and can slide in a guided way into a recess or seat present in the vessel's hull.

This solution may be difficult to implement and use: because of the saltiness, for example, the hinges or the parts in contact and moving with respect to each other may also jam because the swim ladder has a first part which in any event enters the water when the platform is immersed, said first part being hinged to the platform or in any event withdrawing into the seat for the swim ladder provided in the hull, where the guides for the second end of the swim ladder are located, after being immersed in the water (supported on the platform).

EP2065301 describes a vessel provided with a stern platform or swim platform which can also be immersed. This swim platform is in any event associated with a disappearing swim ladder which is inserted into a seat provided in the floor surface of the stern swim platform (and may itself form part of such surface) in a first working position; in its second working position the swim ladder emerges from such seat to reach a wharf to which the boat is moored. No provision is made for swim ladders which are continuously attached to the swim platform when inserted into the vessel's hull.

US2013/0047910 describes a vessel having a tilting frame at its stern which can perform different functions, including that of a platform for swimming or swim platform. The frame can fold onto itself and has a portion acting as a swim ladder. This frame can be adjusted in height relative to the stern of the boat and/or be moved in a longitudinal direction with respect to such stern part.

WO2011/137548 describes a boat with a fixed stern platform provided with a swim ladder or ramp hinged to such stern platform which can be rotated with respect to it. This makes it possible for the swim ladder to be at least partly placed in the water on which the boat floats or be folded back onto the stern or onto the hull of the boat from which said platform projects.

U.S. Pat. No. 7,162,969 describes a boat having a hull and a stern at which there is a moving platform which can be immersed in the water on which the boat lies. Actuator means can displace such platform along guides associated with the hull so that the platform can alternatively adopt at least one first position completely out of the water and a second position which is completely immersed. When immersed the platform releases swim ladders provided within the entire surface of the stern and covered by the platform when it is in its first working position. The platform also provides further steps in a central position; these steps can be covered by a rotating cover.

Such a known solution provides that the boat's stern be constructed in such a way that a plurality of steps also acting as a seat for a person, for example for fishing, can be created therein. This therefore brings about an appreciable modification to the boat's hull at the stern in comparison with normal hulls, with consequent higher design and production costs.

U.S. Pat. No. 4,738,642 describes a jet ski having a supporting platform for the driver and having moving panels at the sides and the rear which can extend into the water under the hull to enable the driver to climb on board the jet ski from the latter's stern without any difficulty due to unbalancing of the jet ski while it is afloat. The fact that the moving panels can extend in the water helps to aid the driver to get back onto the jet ski.

The United States priority document does not relate to a boat with a stern swim ladder extending around the stern, which can move translationally in the water along guides associated with the stern and is capable of acting as a swim platform when taken out of the water.

The object of this invention is to provide a vessel having a stern or after swim platform, which is at least partly movable and which can always be safely reached by the occupants of the boat even when it is immersed.

Another object of the invention is to provide a vessel with a stern swim platform or passerelle which is at least partly movable and from which a person can easily and safely climb on board the vessel without the risk of falling in the water between the hull and said swim platform.

Another object is to provide a boat or vessel provided with a stern space, in particular for a small boat or tender, which can be flooded when the stern platform is immersed in the water.

Another object is to provide a vessel of the type mentioned in which the stern is constructed in such a way as to allow for the stern space to be flooded and for a tender to be easily taken from it or placed in it.

These and other objects which will be obvious to those skilled in the art are accomplished through a vessel according to the appended claims.

The following drawings are appended purely by way of a non-limiting example for a better understanding of the present invention, and in these:

Figure 1:
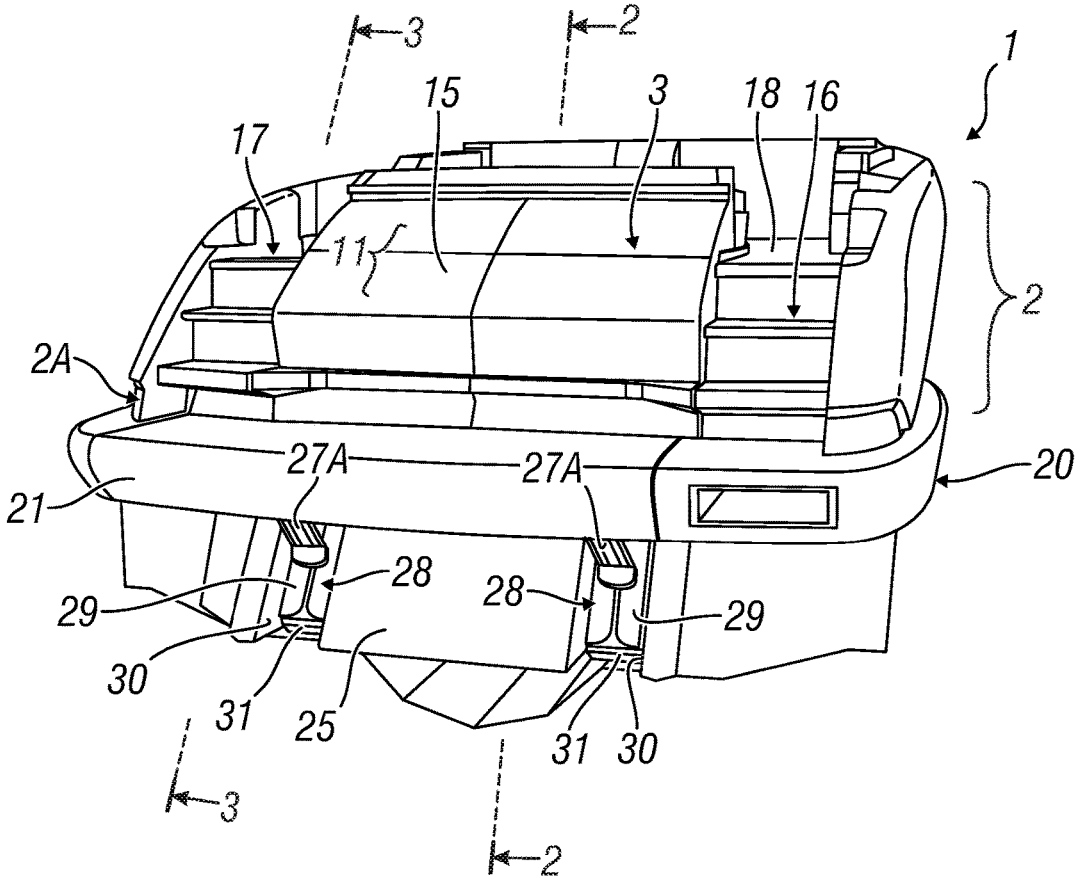
FIG. 1 shows the stern of a particular and illustrative example of a vessel obtained according to the invention which also has a stern space that is shown closed.
Figure 2:
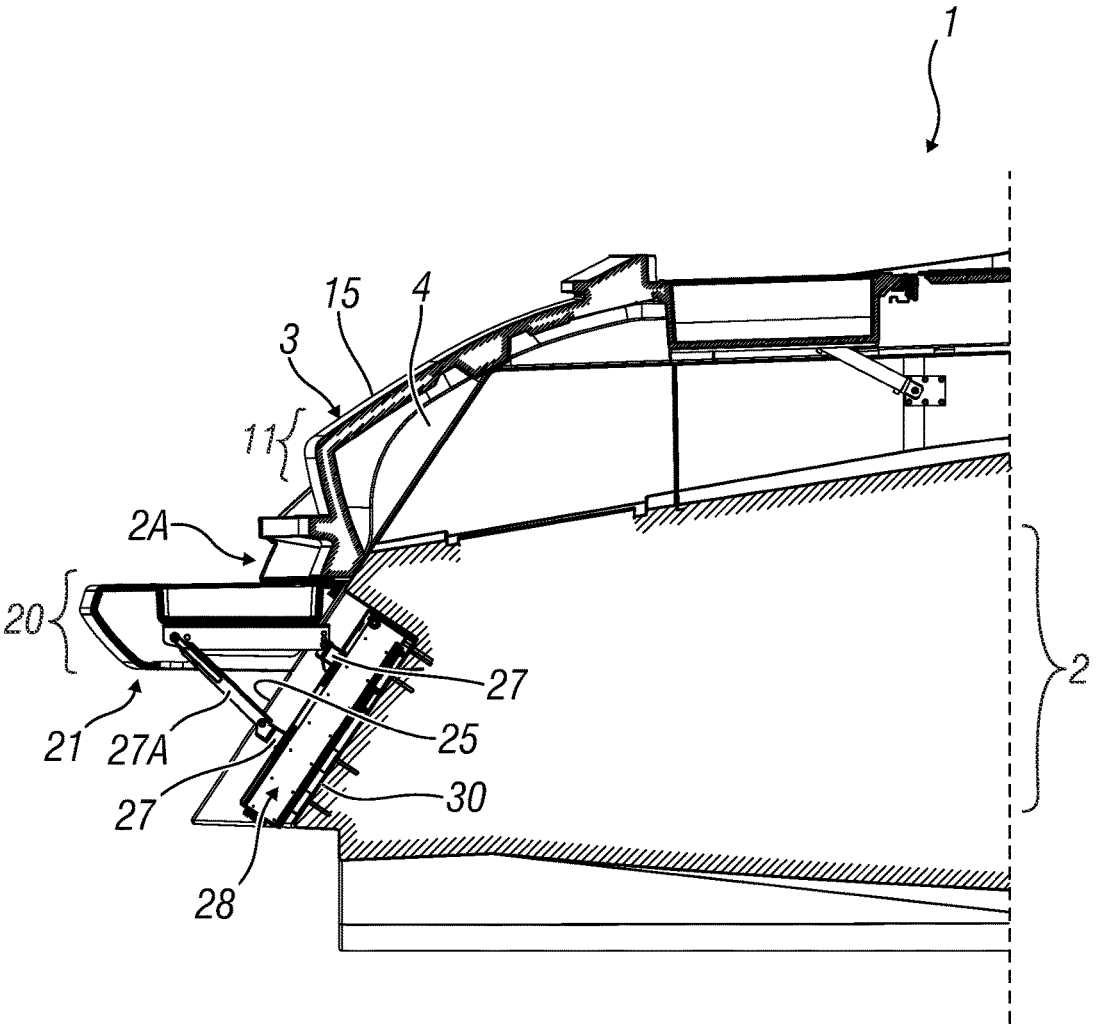
FIG. 2 shows a diagrammatical cross-section along the line 2-2 in FIG. 1.
Figure 3:
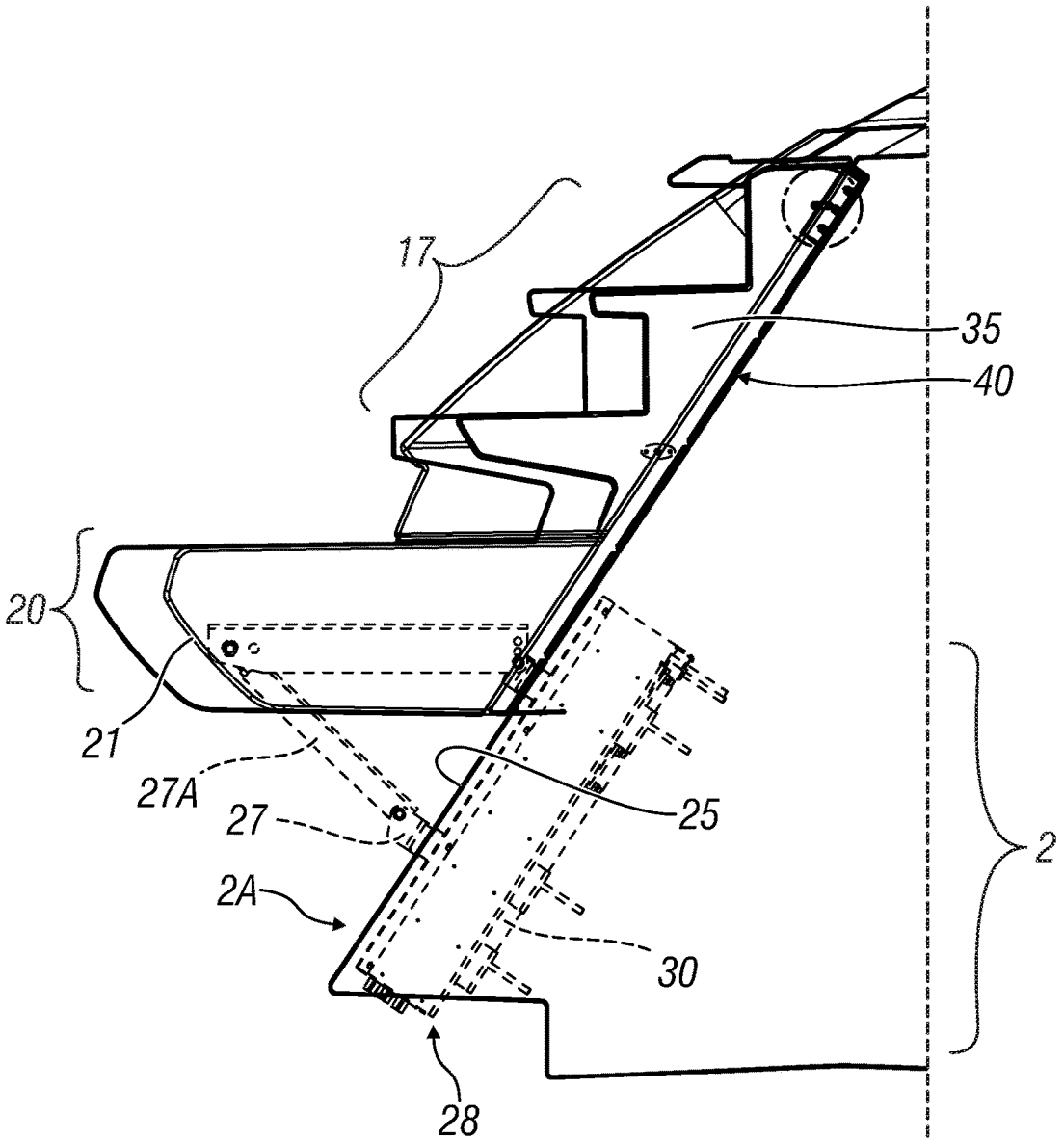
FIG. 3 shows a cross-section along the line 3-3 in FIG. 1.
Figure 6:
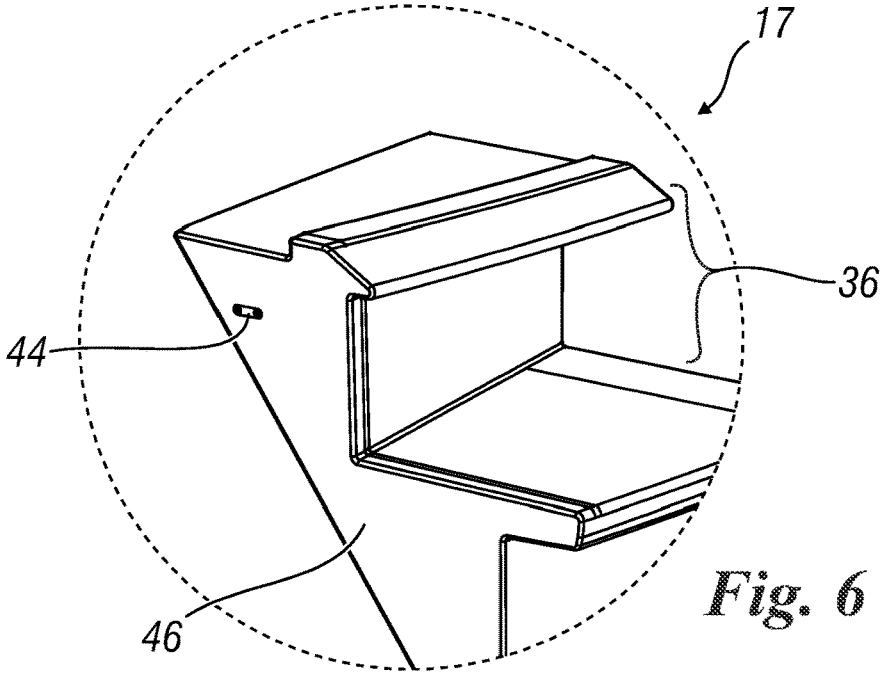
Figure 7:
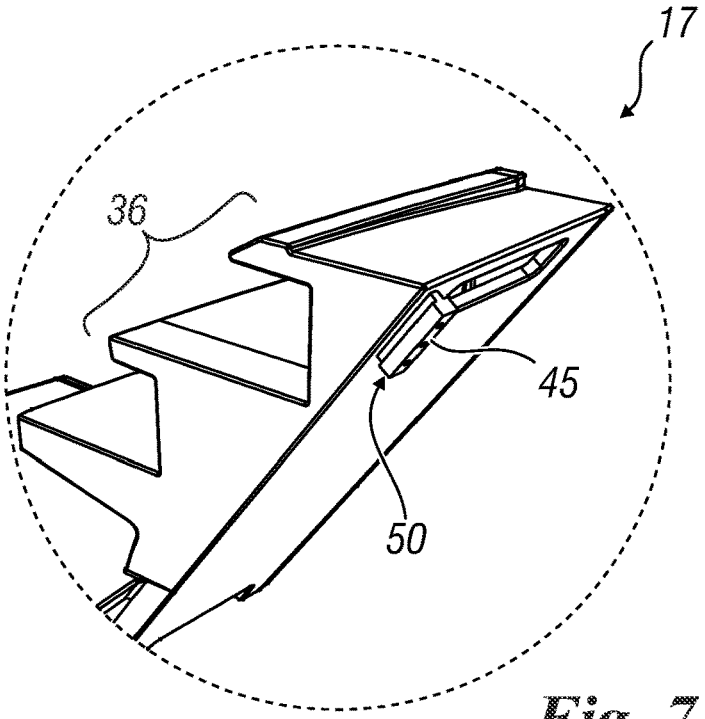
Figure 8:
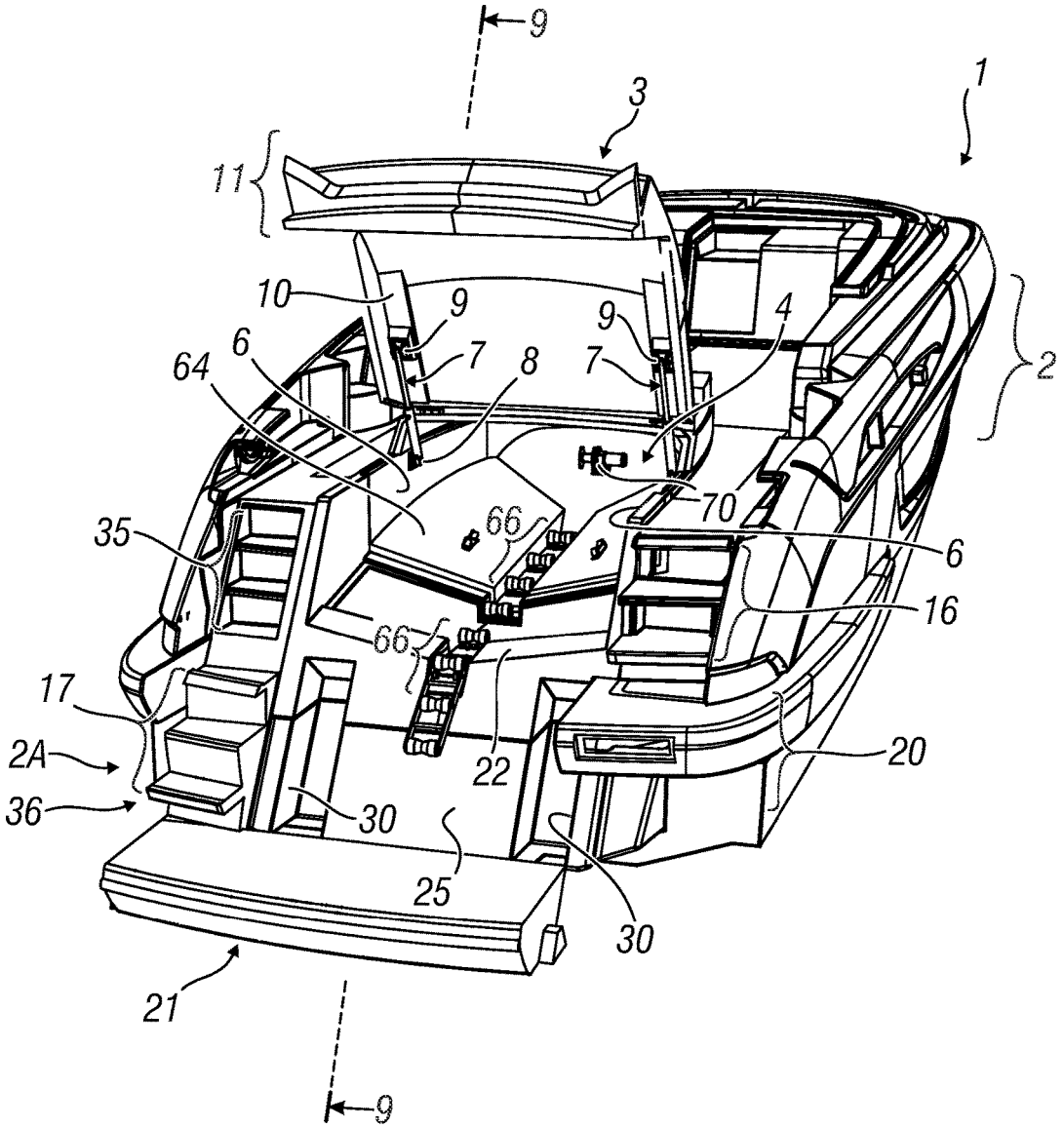
Figure 9:
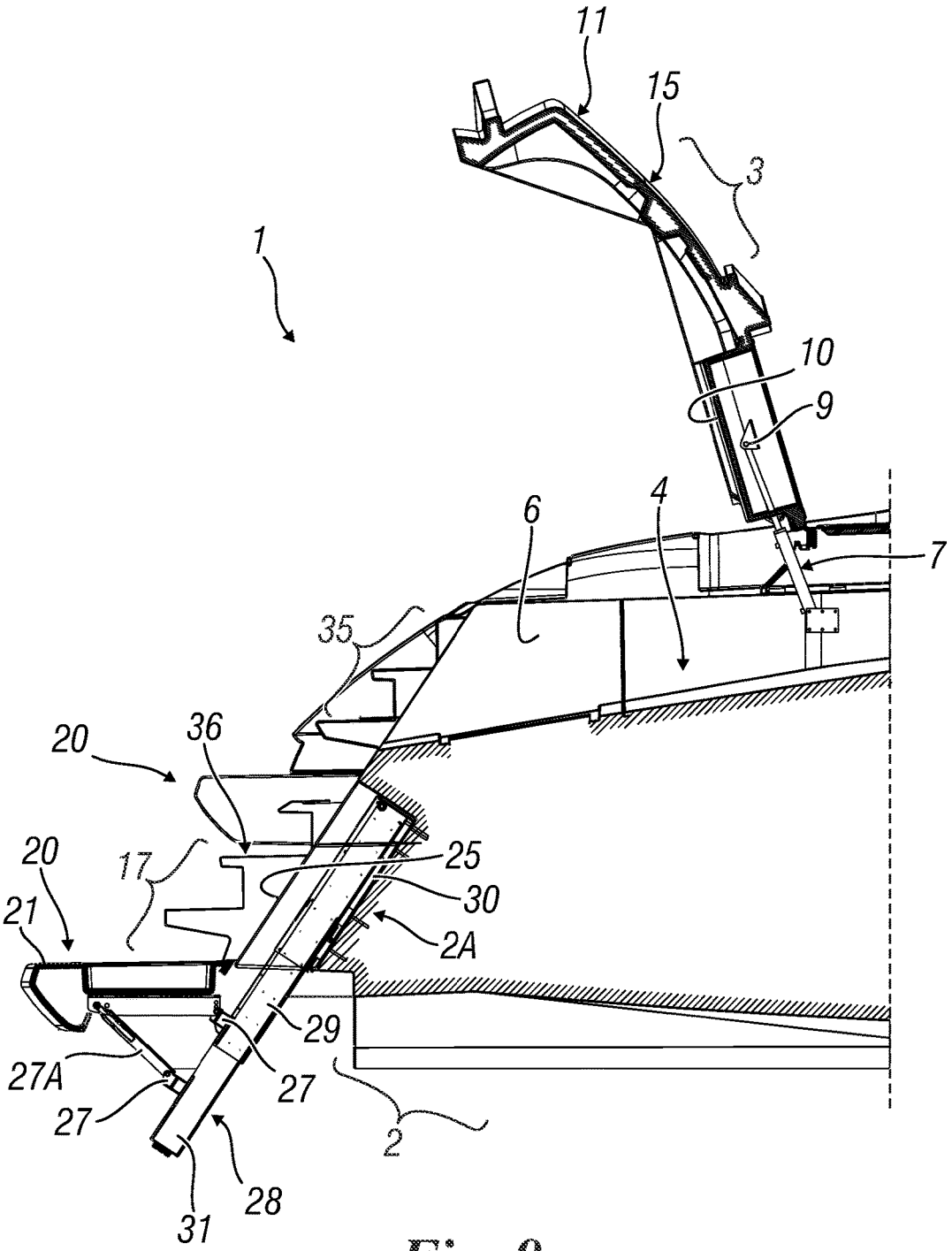
Figure 10:
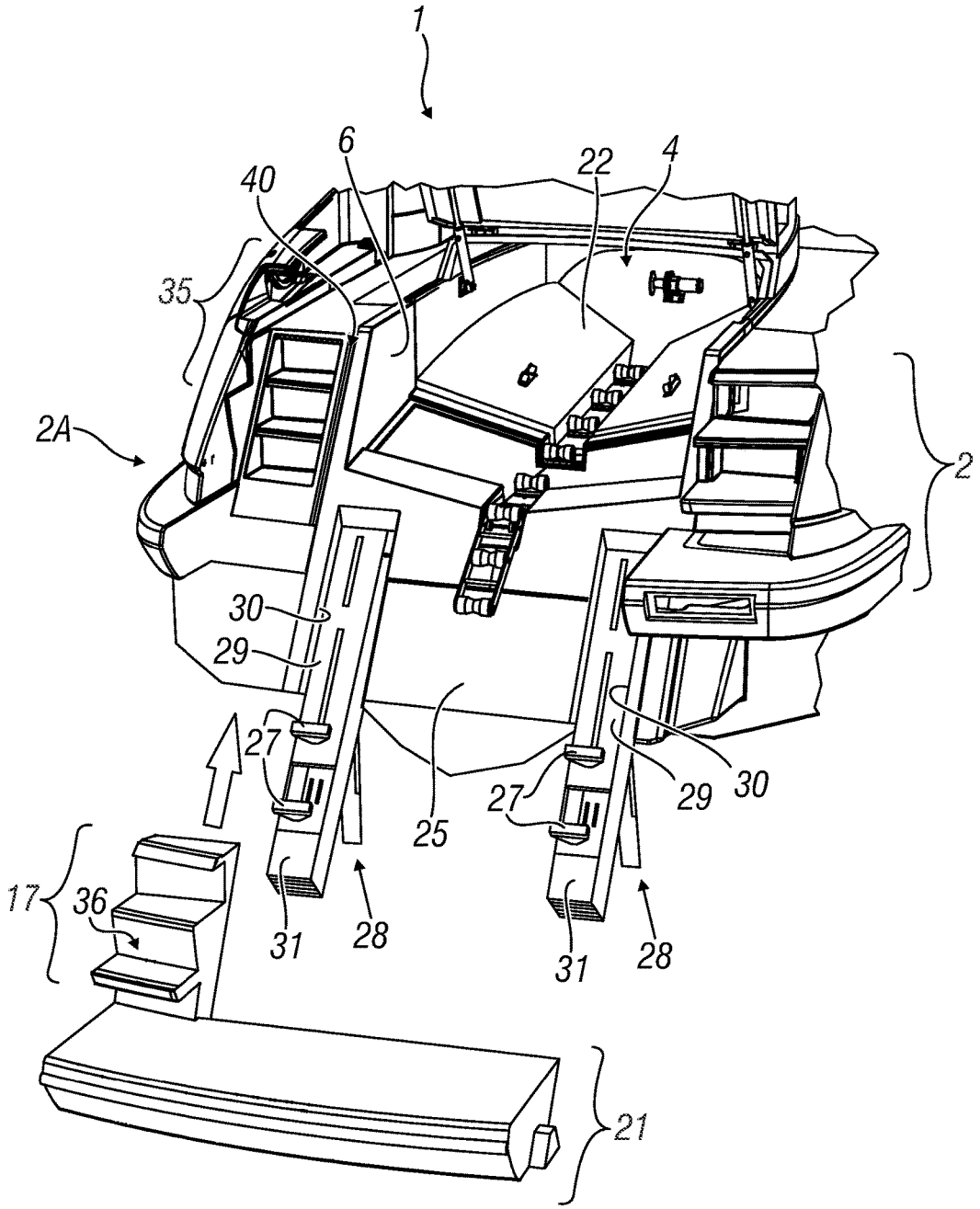
Figure 11:
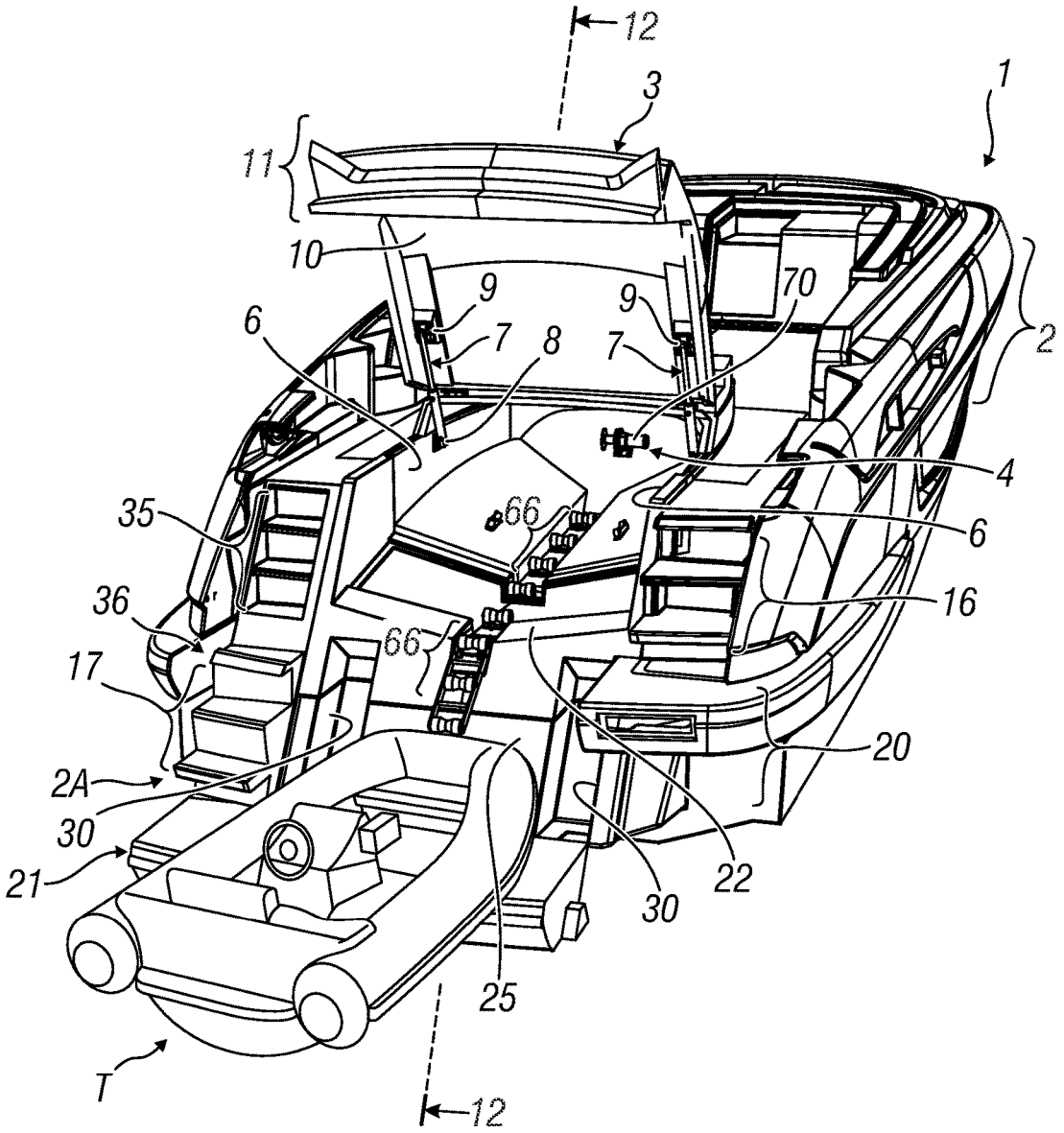
Figure 12:
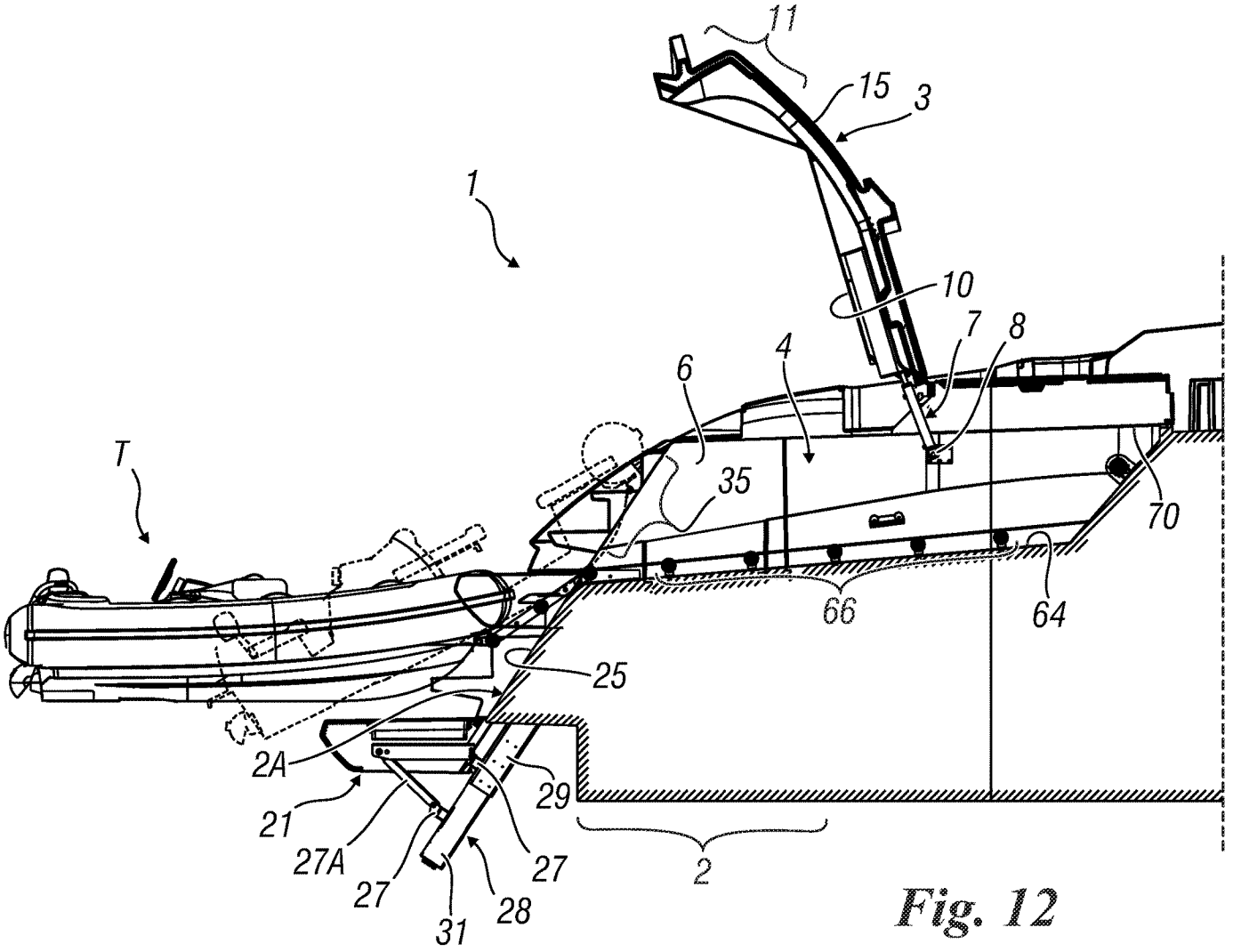

FIGS. 6 and 7 respectively show part of the vessel according to the invention from different angles;

FIG. 8 shows the stern of the vessel in FIG. 1 with the stern swim platform open downwards or immersed in the water and the stern space open, allowing water to access said stern space, which is therefore flooded;

FIG. 9 shows a cross-section along the line 9-9 in FIG. 8;

FIG. 10 shows an exploded view of the stern of the vessel in FIG. 1;

FIG. 11 shows a view similar to that in FIG. 8, but during the first stage of recovering a tender from the water in order to transfer it into the stern space;

FIG. 12 shows a view along line 12-12 in FIG. 11; and

Figure 13:
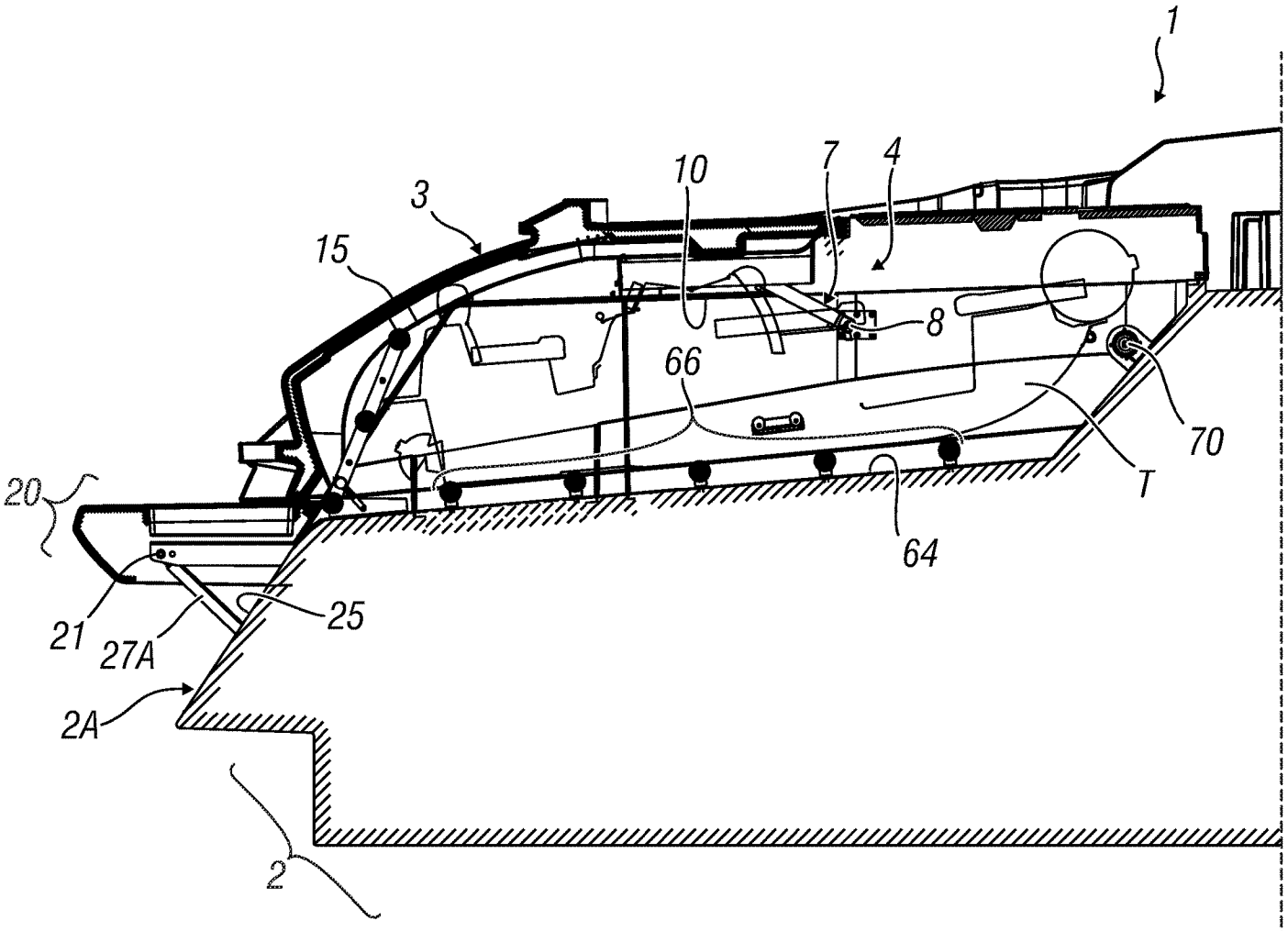

FIG. 13 shows a view similar to that in FIG. 12, but once recovery of the tender into the stern space is complete.

With reference to said figures, there is shown a vessel 1 having a hull 2 comprising a stern 2A and in the example having a stern door 3 capable of closing off a stern space 4 whose function is preferably (but not exclusively) that of containing a small boat such as an inflatable or tender T. This space 4 has opposing side walls 6 to which hydraulic and/or pneumatic actuators 7 enabling door 3 to be opened are hinged. In particular these actuators 7 are each associated with a wall 6 through a first end 8 thereof, their second end 9 being hinged to an inner wall 10 of door 3.

Stern door 3 has a body 11 having an outer wall 15 (generally of fibreglass, like the part of the hull).

At the sides of door 3 there are steps 16 and 17 from which a stern swim platform 20 forming a posterior extension of the vessel can be reached from the surface or deck 18 of hull 2. Advantageously part 21 of such swim platform can move, said part 21 being at least located in relation to door 3 or better the access end 22 of space 4 opening towards stern 2A of the vessel that is located on the water line of the boat or below such line. In this way swim platform 20 can be placed in the water so as to act as a submerged swim platform and free easy access to space 4, which thanks to the fact that its access end 22 is located at least at or beneath the water line of vessel 1 can be flooded for launching or recovering tender T from or into stern space 4.

Part 21 of stern or after stern platform 20 can move along hull 2, in translational motion parallel to itself (or in any translational movement in which part 21 remains on planes which are parallel to each other), but always remains close to the hull and in contact with a portion or part 25 of stern 2A along which the swim platform slides or moves. In this way part of swim platform 21 can be used as a support even when it is immersed, for example to assist getting the tender on board or lowered during the stages of recovery or launching.

In fact, even when completely open and immersed in the water on which vessel 1 lies, part of swim platform 21 always and safely remains in "close" proximity (or effectively in contact) with the hull and in a position lying in a plane parallel to that in which such part lies when access end 22 of stern space 4 is closed.

The part of swim platform 21 is supported by pairs of rests 27 of one piece with corresponding actuators 28 (which are pneumatic, hydraulic, hydropneumatic or mechanical) having a fixed part 29 of one piece with part 25 of stern 2A and inserted into recesses 30 in such part 25. A moving part 31 of actuators 28 moves relative to fixed part 29 and supports a corresponding pair of rests 27. It will be noted that some of rests 27 are directly of one piece with portion 21 of swim platform 20 and some instead are connected to that portion through struts 27A.

Figure 4:
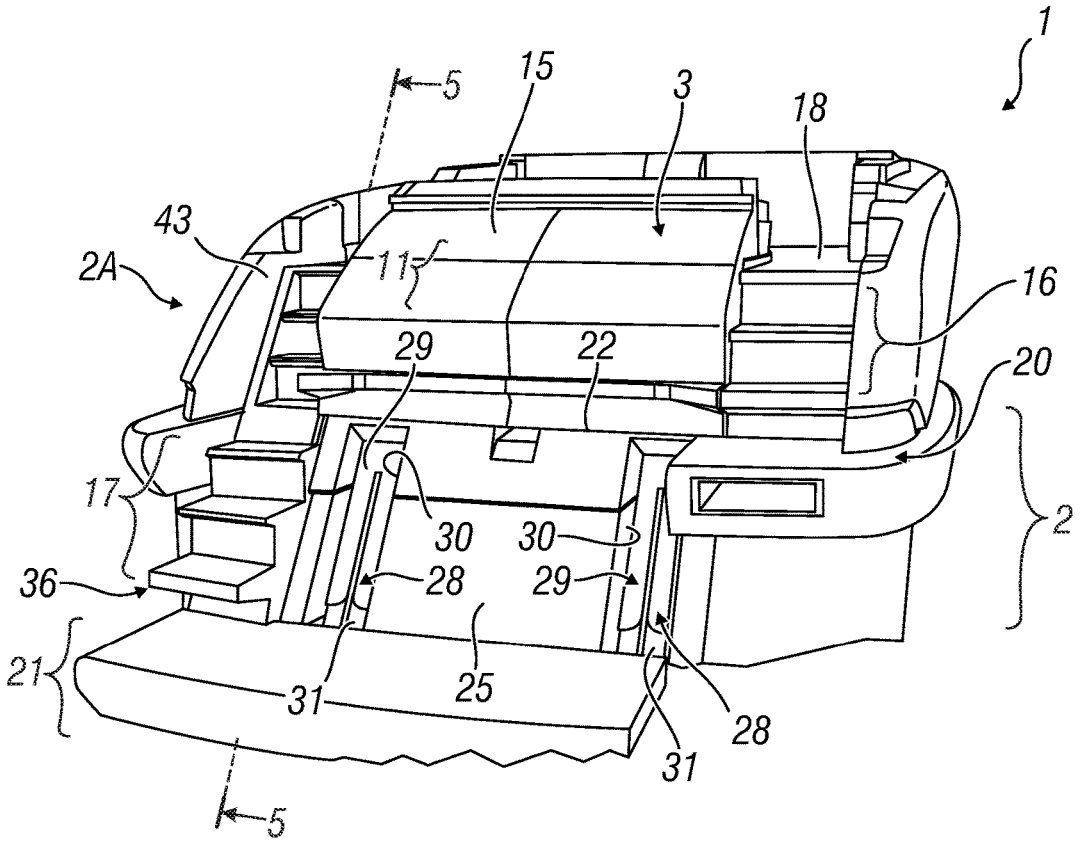
FIG. 4 shows the stern of the vessel in FIG. 1 with the stern swim platform immersed in the water or open and lowered with respect to the stern space.
Figure 5:
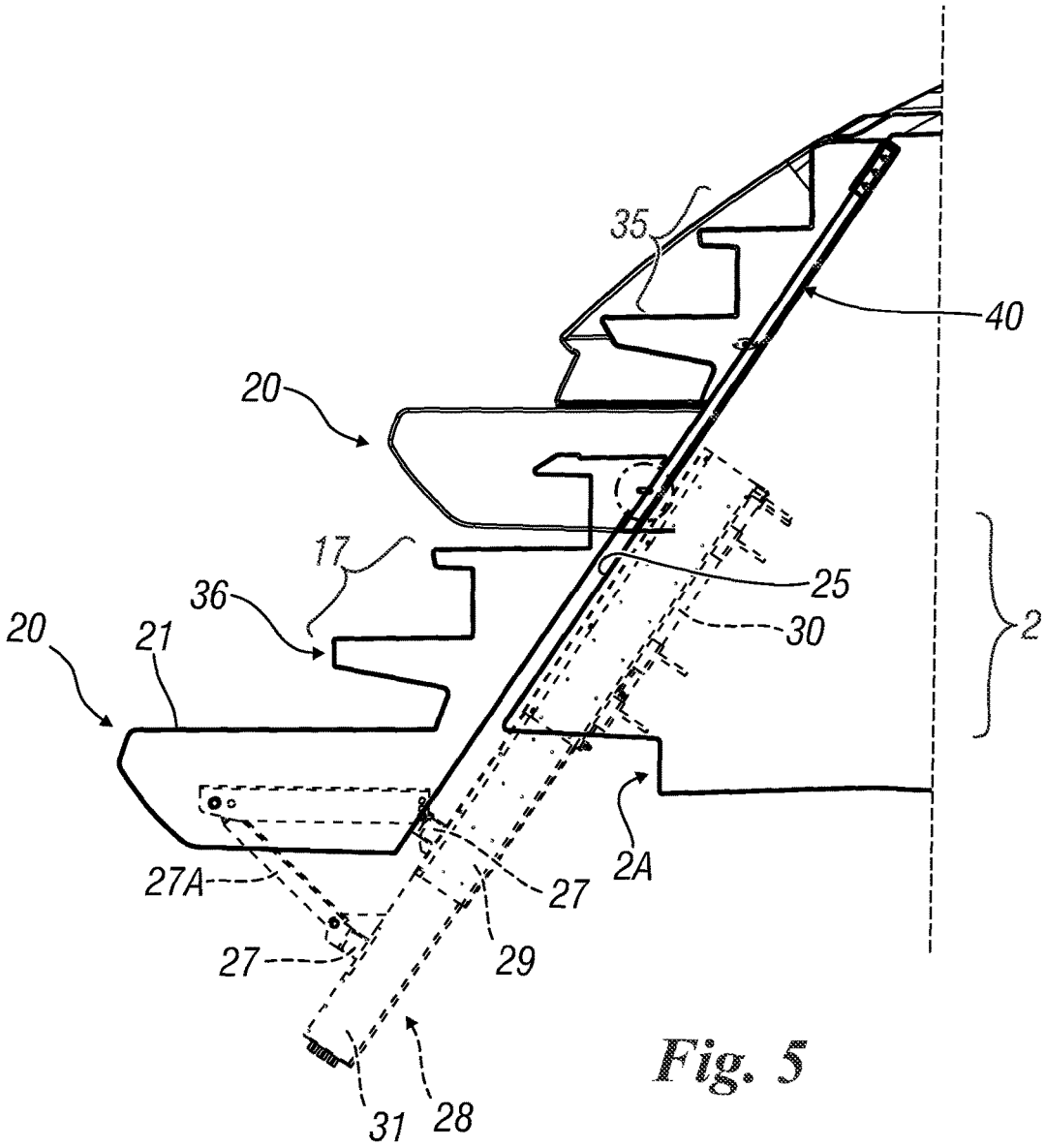
FIG. 5 shows a cross-section along the line 5-5 in FIG. 4.

The movement of moving parts 31 with respect to fixed parts 29 causes the part of swim platform 21 to move and thus adopt a first working position (shown in FIG. 1 and subsequent figures) out of the water and at least a second working position immersed in the water (shown in FIG. 4 and subsequent figures). Obviously the part of swim platform 21 may adopt any other position between said first and second working positions.

The moving part of swim platform 21 is rigidly associated with (or is directly of one piece with) steps 17 thus forming a movable swim ladder 36 which is capable of sliding over fixed steps 35 provided between stern 2A of vessel 1 corresponding to steps 17 when such part 21 is in the first working position. These steps 17 may be an independent body which is mechanically attached (in any known way) to the part of swim platform 21, or may be directly of one piece with such part 21 and project from it.

When such part of swim platform 21 is in its second working position or completely immersed in the water moving swim ladder 36 allows access to steps 35 above it and forms an extension of steps 35 allowing easy movement from the hull to the swim platform or vice versa by the occupants of the vessel (to reach the water or to easily reach a part of moving swim platform 21 in order to work on tender T or leave on it).

Swim ladder 36 (or steps 17) rigidly attached to the part of swim platform 21 moves along at least one fixed guide 40 provided at the side of steps 35: the latter are "hollowed out" in the stern 2A of hull 2 (precisely where steps 17 are located when the part of the moving platform is in the first working position) and therefore do not interfere with the movement of steps 17.

As may be seen in FIGS. 4, 6 and 7, either at the side of steps 35 or associated with steps 17 or swim ladder 36 there are sensor means capable of checking the position of the part of swim platform 21 with respect to the hull. In particular, on stern 2A at steps 35 there are fixed sensors 43 which detect the positions corresponding to moving reference bodies 44, 45 associated with swim ladder 36. In particular body 44 is of one piece with one side 46 of swim ladder 36, while bodies 47 are of one piece with a member 50 which can move in fixed guide 40 mentioned above.

Obviously the moving part of swim platform 21 is moved under the control of a control unit (not shown) to which fixed sensor means 43 and actuators 28 described above are connected.

Thanks to the invention there is therefore provided a moving swim platform (in its part 21) with which are associated steps 17 which can move in a way which is guided (through fixed guide 40) and controlled (through sensors 43) over fixed steps 35 provided and constructed in a manner located in stern 2A. When the swim platform is immersed in the water this makes it possible to create a succession of steps (steps 17 and fixed steps 35) thus forming an elongatable swim ladder such as to allow easy and safe movement of persons to and from the immersed platform. This extension is safely obtained because steps 17 have a fixed shape which does not change when the swim platform is in either the first working position or the second working position.

The figures show that only a part 21 of swim platform 20 can move. Obviously all of swim platform 20 may be able to move with respect to hull 2.

In this case not only are steps 17 rigidly attached to the moving swim platform, but preferably so also are steps 16. In this case these steps 16 move in the same way as steps 17, are rigidly attached to the swim platform (or are of one piece with it) and move on steps located beneath, similarly to steps 35, within stern 2A in a position located in the latter.

In addition to this, the position of the steps, the fact that they are located at the sides of door 3 and space and their number are characteristic of the invention. Also depending upon the type of boat and the dimensions of stern 2A the number of steps 16, 17 and therefore steps 35 may vary and be more or fewer than those shown in the figures. In addition to this, the steps may be provided on only one side of space 4.

Also, when the vessel is not provided with space 4, but only one or several sets of steps and the moving swim platform, the steps may also be located in a different position on the stern (always that is located so as not to engage the entire stern) in comparison with that shown in the figure.

Finally, in addition to what has been described, from its access end 22 and along its lower surface 64 (ending at that end) space 4 may be provided with idling or driven members or rollers 66, or other means capable of aiding the movement of tender T during the stages of removing it from the said space and recovering it within it. An internal winch 70 is also provided in space 4, as shown in FIGS. 11-13. It should be noted that rollers 66 close to access end 22 of space 4 can be tilted to further assist the movement of tender T.

Various embodiments of the invention have been described and mentioned. Yet others are however possible in the light of the following claims. For example space 4 may only be enclosed at the bottom by the moving part of swim platform 21 and door 3 may not be present (being open at the position occupied by the latter shown in the figures). This solution may for example be used on vessels of smaller size and lesser value than those also having a door as indicated by 3 in the figures appended to this description.

The invention claimed is:

1. A vessel or boat comprising a hull having a stern at which there is a stern swim platform having at least one moving part capable of moving along and close to a portion of the stern, said moving part being associated with actuators of one piece with the hull and capable of moving said moving part along the portion of the stern, said moving part being able to adopt at least one first working position in which it is out of the water on which the boat lies and a second working position in which said moving part is lowered with respect to the hull into the water, steps being provided at said stern capable of permitting passage from a deck of the hull to said stern swim platform, wherein at least some of said steps are of one piece with the moving part of the stern swim platform and move therewith over further fixed steps provided in said stern, said movement of the steps being performed in a guided way, the moving steps together with the fixed steps forming an elongatable swim ladder, said moving steps covering the fixed steps when the moving part of the swim platform is in the first working position, said moving steps freeing access to the fixed steps when said moving part of swim platform is in its second working position, the moving steps forming an extension of the fixed steps in this second position, wherein the hull defines a stern space, said stern space for housing a tender and being provided with its own moveable closing door, the stern space both sides being opposed respective first and second lateral sides, wherein one flight of the moving steps is located along the first lateral side of said stern space, wherein one flight of the fixed steps is permanently exposed to be capable of permitting passage from the deck of the hull to a portion of the stern swim platform which is immoveable, wherein the one flight of the fixed steps which is permanently exposed is located along the second lateral side of the stern space, wherein a second flight of fixed steps is located under the one flight of moving steps when the swim platform moving part is in the first working position, the stern space being located above the stern swim platform moving part when the stern swim platform moving part is in the first working position and when the stern swim platform moving part is in the second working position.

2. The vessel according to claim 1, wherein said moving steps are formed by a body which is independent of the stern swim platform but mechanically attached to the moving part of that swim platform.

3. The vessel according to claim 1, wherein said moving steps are of one piece with the moving part of said stern swim platform.

4. The vessel according to claim 1, wherein provision is made for at least one fixed guide located in relation to fixed steps and of one piece with the hull along which a member of one piece with the moving steps moves.

5. The vessel according to claim 1, wherein there are functionally associated with the moving steps sensor means capable of controlling the movement of said moving steps with respect to the fixed ones and as a consequence controlling movement of the moving part of the swim platform with respect to the hull.

6. The vessel according to claim 5, wherein said sensor means comprise fixed sensors of one piece with the hull and located close to the fixed steps capable of detecting the position of moving reference bodies of one piece with the moving steps.

7. The vessel according to claim 4, wherein at least one of the reference bodies is of one piece with the moving member in the fixed guide.

8. The vessel according to claim 1, wherein it comprises a unit controlling the movement of the part of the moving swim platform connected to the actuators for moving said part of the moving swim platform and the sensor means functionally associated with the moving steps.

9. The vessel according to claim 1, wherein the steps capable of permitting passage from a deck of the hull to said stern swim platform are located on both sides of said stern space, at least part of such steps being formed by the moving steps and the fixed steps.

10. The vessel according to claim 1, wherein the entire stern swim platform can move with respect to the hull and in that moving steps are associated therewith.

11. The vessel according to claim 1, wherein said moving steps are formed by a body which is independent of the stern swim platform but mechanically attached to the moving part of that swim platform or said moving steps are of one piece with the moving part of said stern swim platform.

12. The vessel according to claim 11, wherein the moving steps cover a second flight of fixed steps when the moving part of said stern swim platform is in the first working position.

13. The vessel according to claim 11, wherein an access end of the stern space is designed and configured to be on or below a water line of the vessel.

14. The vessel according to claim 1, wherein the moveable steps are exposed to provide access to the moving part of said stern swim platform when the moving part of said stern swim platform is in the first working position and the second working position.

15. A vessel or boat comprising a hull having a stern at which there is a stern swim platform having at least one moving part capable of moving along and close to a portion of the stern, said moving part being associated with actuators of one piece with the hull and capable of moving said moving part along the portion of the stern, said moving part being able to adopt at least one first working position in which it is out of the water on which the boat lies and a second working position in which said moving part is lowered with respect to the hull into the water, steps being provided at said stern capable of permitting passage from a deck of the hull to said stern swim platform, wherein at least some of said steps are of one piece with the moving part of the stern swim platform and move therewith over further fixed steps provided in said stern, said movement of the steps being performed in a guided way, the moving steps together with the fixed steps forming an elongatable swim ladder, said moving steps covering the fixed steps when the moving part of the swim platform is in the first working position, said moving steps freeing access to the fixed steps when said moving part of swim platform is in its second working position, the moving steps forming an extension of the fixed steps in this second position, wherein the hull defines a stern space, said stern space for housing a tender and being provided with its own moveable closing door, the stern space both sides being opposed respective first and second lateral sides, wherein a first flight of the moving steps is located along the first lateral side of said stern space when the moving part of said stern swim platform is in the first working position, wherein the first flight of moving steps covers a first flight of the fixed steps when the moving part of said stern swim platform is in the first working position, wherein when the moving part of said stern swim platform is in the second working position the first flight of the moving steps extends from the first flight of the fixed steps, wherein the first flight of the fixed steps is capable of permitting passage from the deck of the hull to the first flight of the moving steps and the first flight of the moving steps is capable of permitting passage from the first flight of fixed stairs to the portion of the stern swim platform which is moveable.

16. The vessel according to claim 15, wherein said moving steps are formed by a body which is independent of the stern swim platform but mechanically attached to the moving part of that swim platform or said moving steps are of one piece with the moving part of said stern swim platform.

17. The vessel according to claim 15, wherein an access end of the stern space is designed and configured to be on or below a water line of the vessel.

18. The vessel according to claim 15, wherein the moveable steps are exposed to provide access to the moving part of said stern swim platform when the moving part of said stern swim platform is in the first working position and the second working position.

19. The vessel according to claim 15, wherein the steps capable of permitting passage from a deck of the hull to said stern swim platform are located on both sides of said stern space, at least part of such steps being formed by the moving steps and the fixed steps.

* * * * *